US005911946A

United States Patent [19]

Aichinger et al.

[11] Patent Number: 5,911,946

[45] Date of Patent: Jun. 15, 1999

[54] SNORKEL FOR A DEGASSING VESSEL

[75] Inventors: Klaus Aichinger; Harald Harmuth, both of Villach, Austria; Heinrich Niehues, Mülheim, Germany; Armin Pertl, Leoben, Austria

[73] Assignee: Veitsch-Radex Aktiengesellschaft fur Feuerfeste Erzeugnisse, Vienna, Austria

[21] Appl. No.: 08/949,809

[22] Filed: Oct. 14, 1997

Related U.S. Application Data

[63] Continuation of application No. 08/621,710, Mar. 28, 1996, abandoned.

[30] Foreign Application Priority Data

Mar. 30, 1995 [DE] Germany ..... 195 11 640

[51] Int. Cl.[6] ..... B22D 41/04

[52] U.S. Cl. ..... 266/209; 266/209; 266/208; 222/603

[58] Field of Search ..... 501/120, 99; 266/208, 266/209, 210, 286; 222/603

[56] References Cited

U.S. PATENT DOCUMENTS

| | | | |
|---|---|---|---|
| 5,024,421 | 6/1991 | Cooley | 266/210 |
| 5,506,181 | 4/1996 | Matsumoto et al. | 501/120 |

FOREIGN PATENT DOCUMENTS

| | | | |
|---|---|---|---|
| 0297850 | 1/1989 | European Pat. Off. . | |
| 2145740 | 3/1985 | United Kingdom | 266/209 |

*Primary Examiner*—Scott Kastler
*Attorney, Agent, or Firm*—John F. A. Earley; John F. A. Earley III; Harding, Earley, Follmer & Frailey

[57] ABSTRACT

The present invention pertains to a snorkel for a degassing vessel, with a refractory lining and a gas-purging device arranged therein with a plurality of channels, which, distributed over the circumference of the snorkel, extend through the refractory lining in the radial direction in relation to the central longitudinal axis of the snorkel and can be connected on the outside to at least one gas supply line.

18 Claims, 1 Drawing Sheet

SNORKEL FOR A DEGASSING VESSEL

This is a continuation of copending application Ser. No. 08/621,710 filed on Mar. 28, 1996 now abandoned.

FIELD OF THE INVENTION

1. Specification

The present invention pertains to a snorkel for a degassing vessel with a refractory lining and a gas-purging device arranged therein with a plurality of channels, which, distributed over the circumference of the snorkel, extend through the refractory lining in the radial direction relative to the central longitudinal axis of the snorkel and can be connected on the outside to at least one gas supply line.

2. Background of the Invention

The development of gas-purging elements for degassing vessels is described in Radex-Rundschau, No. 4, 1990, p. 365. It is mentioned there that purging is performed in a typical plant with 6 to 12 tubes with a diameter of 3 or 4 mm each in the intake part of the snorkel of the vacuum vessel.

An RH process, in which argon is blown in in the intake part of the snorkel through steel tubes with a diameter of 3 to 4 mm, is described in Radex Rundschau, No. 4, 1992, p. 171.

In the RH (Ruhrstahl-Heraeus) process, the molten steel is fed from a casting ladle into the evacuating vessel in a feed tube by means of a delivery gas, especially argon, which is introduced into the feed tube above the level of the steel bath, due to the increase in the volume of this [gas] in the feed tube as well as due to the difference in pressure between the outer air pressure and the vacuum in the evacuating vessel. The steel drawn into the evacuating vessel is atomized, as a result of which a great increase in surface and thus good degassing take place. Oxygen introduced at the same time, of which more is supplied, among other things, from the slag during the entire treatment time, leads to the formation of carbon monoxide, which evolves in the vacuum vessel in order to achieve the desired decarbonization.

Attempts were made by additionally blowing in oxygen to optimize the fine decarbonization at the lowest possible values.

A rapid decarbonization process is achieved especially by a high velocity of circulation of the melt and consequently by increasing the flow of delivery gas and increasing the diameter of the blowpipe (snorkel) of the vacuum unit.

A snorkel of the above-described class is described in EP 0 297 850 A1 in connection with an RH process. A plurality of channels, which are divided into two groups, are arranged for this purpose in the intake part on the circumference, with gas under high pressure being admitted to one group and gas under low pressure to another group. The gas flows fed in shall thus penetrate to different depths into the metal melt guided through the snorkel, and uniform gassing of the metal melt over the cross section of the blowpipe shall be achieved.

Chromium-containing magnesia grades, which are characterized by good durability, are usually used as the refractory material for the said snorkel area. However, the use of chromium-containing types is now increasingly met with concerns for environmental reasons. Legal regulations sometimes require the complete abandonment of chromium-containing materials.

SUMMARY OF THE INVENTION

The basic object of the present invention is to optimize prior-art snorkel for degassing vessels, seeking to achieve especially reduced and more uniform wear behavior of the refractory ceramic lining.

The present invention is based on the finding that this object can be achieved by an "all-around purging" of the steel guided through the snorkel (the submerged tube) with a corresponding treating gas in combination with a special selection of the material for the refractory lining of the snorkel if the following parameters are taken into account:

The gas shall be fed in on the circumferential side as a nearly continuous gas curtain.

The refractory lining of the snorkel shall consist, at least in the area of the channels, completely of a chromium-free refractory ceramic material.

The described design of a gas-purging device, in which very fine gas bubbles are admitted to enter into the metal melt (passed through the snorkel) nearly contiguously (continuously), leads to such a markedly surprising advantage of the treatment of the metal melt from a metallurgical viewpoint that the snorkel can now be lined, at least in the area of the channels, with a refractory material that consists of a chromium-free magnesitic type.

Even though chromium-free magnesia products have been known in the state of the art (DE 43 19 741 A1; DE 35 27 789 C2), these are intended for different applications.

The use of chromium-free types of magnesia in a snorkel according to the state of the art has not been possible until now for reasons of durability. However, the above-described purging technique makes it now possible, in conjunction with the specially designed gas-purging device, to use chromium-free, especially basic refractory types without any problem, without the durability of the snorkel being appreciably compromised. This represents a considerable progress from an environmental engineering viewpoint.

The suitable materials specifically include, e.g.,

MA spinels ($MgO$-$Al_2O_3$ spinel compositions and bricks), magnesia spinel bricks and compositions, magnesia compositions and bricks with MgO contents exceeding 97 wt. %, which are doped with $ZrO_2$ or $Al_2O_3$, or magnesia types containing less than 1.0 wt. % of metallic additives in the granular form with a particle size between 0.1 and 2.0 mm, magnesia with up to 8.0 wt. % of other refractory oxides added in the granular, compacted or lumpy form with a particle size <5 mm.

The above list is given only by way of example. Other types, e.g., those according to DE 43 19 741 A1, may be used as well.

In a particularly advantageous embodiment, it is also possible to use refractory materials which are impregnated with pitch. The durability level of the snorkel can thus be further increased.

Thus, the present invention pertains, in its most general embodiment, to a snorkel of the above-described class for a degassing vessel, wherein the channels are arranged circumferentially at closely spaced locations from one another along the inner wall of the blowpipe to generate a nearly contiguous gas curtain, and the lining of the blowpipe consists of a chromium-free refractory material, at least in the area of the channels, but preferably completely.

The following advantages arise from such a design: A uniform flow of molten steel into the vacuum vessel is achieved. The gas supply distributed over the entire circumference, preferably in the form of fine bubbles, makes possible an especially fine distribution of the treating gas, along with a greatly increased reaction volume between the treating gas and the steel melt.

The gas, e.g., argon, rises at the inner wall of the snorkel, thus protecting the refractory lining material of the snorkel. The consequence is a much more uniform and lower wear of the refractory material not only in the snorkel itself, but also in the lower vessel of the vacuum unit. Skull formation, which was sometimes observed according to the state of the art in the middle and upper parts of the vacuum vessel, does not practically occur any more. The treatment time of the steel with alloying elements is reduced. The amount of alloying agent needed correspondingly decreases as well. Finally, a higher decarbonization performance and more rapid decarbonization can be achieved, so that smaller amounts of reducing agents are needed.

The design embodiment of the annular gas-purging device may be modified in various ways. In a first embodiment, the gas-purging device is designed as a monolithic, cast or pressed, annular block, in which the channels are arranged correspondingly in a radial pattern.

The annular block may also comprise a plurality of refractory ring segments, e.g., pressed ring segments, wherein the channels extend in the individual segments.

Each ring segment is now provided with a plurality of channels, and in another embodiment, the channels of one ring segment join on the outside a common gas distribution chamber, which itself can in turn be connected to a gas supply line. The gas distribution chambers may also be connected to one another in terms of flow, so that only a single gas supply line is needed. The gas flow supplied is more uniform as a result. In conjunction with the feature of designing channels with very small width of opening (or very small diameter), this makes it possible to work with a markedly lower gas pressure compared with the state of the art. The gas pressure is set to be such that the above-described formation of a circular gas curtain is achieved.

The shape and size of the ring segments may be varied within wide limits. It is possible, e.g., to build up the annular gas-purging device from a total of 10 ring segments. Each ring segment may in turn comprise a plurality of bricks, with the channels being provided in all bricks.

Regardless of the design embodiment of the annular gas-purging device, the gas channels may be arranged in a rotationally symmetrical pattern over the circumference of the refractory lining of the snorkel. An especially uniform supply of gas into the metal melt is guaranteed hereby. If the gas channels are designed with different diameters (e.g., 0.5 to 1.5 mm) or cross sections (e.g., round, slot-like, etc.), the gas pressure can also be set from one channel to the next such that the gas actually being supplied can penetrate to different depths into the metal melt, but, as is described, only over a relatively short section according to the present invention.

The channels may be simple holes; according to one embodiment, the channels are formed by metal tubes, which are firmly seated in the refractory lining.

The distribution of the treating medium within the metal melt is also improved by the gas channels being arranged alternatingly offset in height. The following exemplary embodiment specifically shows such an embodiment.

The channels are normally directed horizontally; however, an arrangement of the channels in which they are inclined relative to the horizontal is also conceivable, in which case the channels are directed, e.g., such that the gas is supplied opposite the direction of flow of the metal melt.

Other features of the present invention will appear from the features of the subclaims as well as the other application documents.

The present invention will be explained in greater detail below on the basis of an exemplary embodiment.

BRIEF DESCRIPTION OF THE DRAWINGS

In schematic representations.

DESCRIPTION OF PREFERRED EMBODIMENTS OF THE INVENTION

Figure 1:
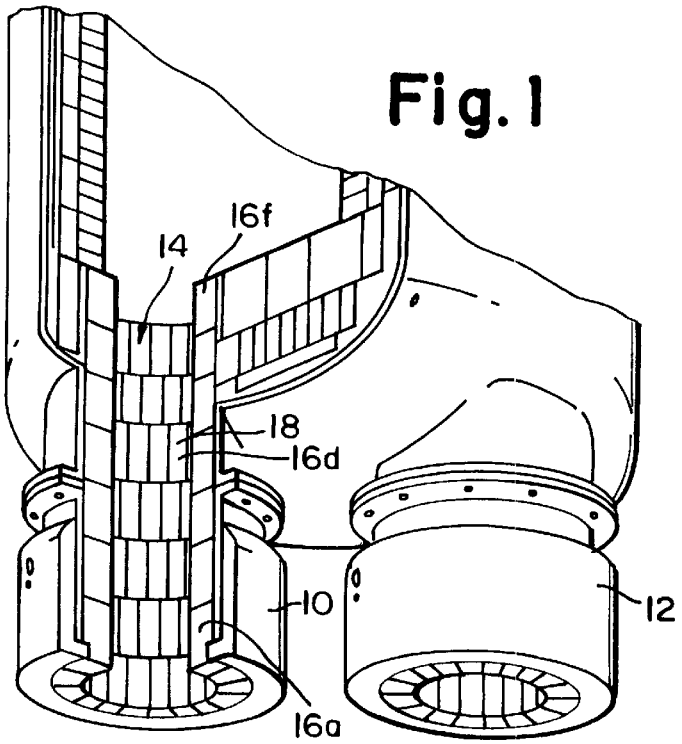
FIG. 1 shows a perspective, partially cutaway view of an RH degassing vessel.

FIG. 1 shows a partially perspective view of an RH degassing vessel and especially the area of two snorkels (intake snorkel 10, outlet snorkel 12), which is of interest here.

A refractory lining 14, which comprises here a total of 7 annular planes 16*a* . . . *f* arranged one above the other, can be recognized in the cutaway part of the snorkel 10. Each plane 16*a* . . . *f* is composed of refractory bricks 18.

Figure 2:
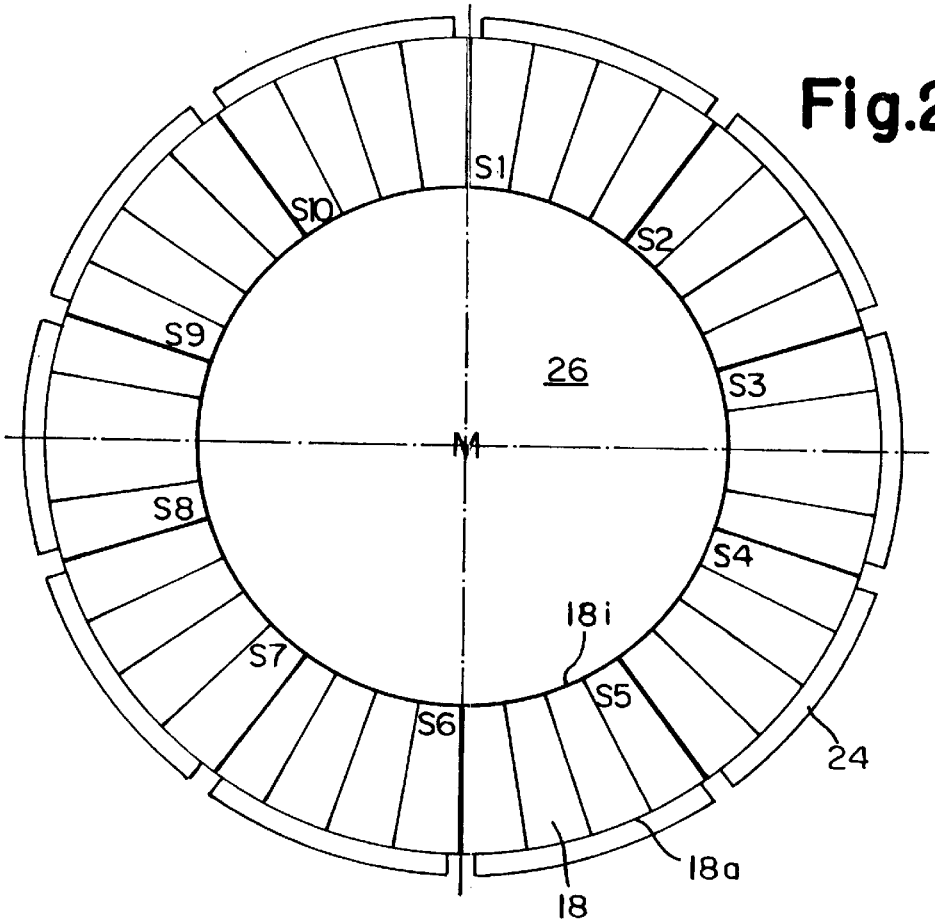
FIG. 2 shows a horizontal section through the snorkel according to FIG. 1 in the area of the gas-purging device.

The bricks 18 of plane 16*d* together form a gas-purging device according to the present invention, which is specifically shown in FIG. 2 as a top view.

FIG. 2 shows that forty bricks 18 together form the annular plane 16*d,* with four bricks 18 each united into a ring segment S1 through S10. The bricks 18 or segments S1 through S10 are joined together with mortar at their corresponding lateral surfaces.

Figure 3:
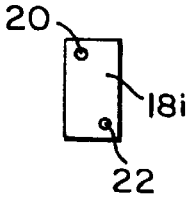
FIG. 3 shows a front view of a snorkel brick according to FIG. 2.

As is shown in FIG. 3, each brick 18 has two horizontally directed channels 20, 22, which extend radially in relation to the central longitudinal axis M of the snorkel 10 and are arranged offset in height and laterally, and the distance between them is about 5 cm, both between the channels 20, 22 of one brick and between the channels of adjacent bricks.

The channels 20, 22 (with an internal diameter of 1 mm each) extend from the outside 18*a* to the inside 18*i* of the bricks 18.

Each segment S1 through S10 has on its outer surface a directly connected gas distribution chamber 24, which is connected to the outer surface in a gas-tight manner and consists of metal. The channels 20, 22 correspondingly extend on the outside into the space formed by the gas distribution chamber 24.

Each gas distribution chamber 24 has a connection area (not shown here), via which the gas distribution chamber 24 is supplied with the treating medium, which can subsequently be injected into the interior space 26 of the snorkel through the channels 20, 22, and the uniform and closely spaced distribution of the channels 20, 22, offset in height, over the circumference of the gas-purging device, as well as their radial direction ensure that the treating medium, e.g., argon, is injected uniformly radially in the direction of the metal melt flowing in the space 26. A type of circular, annular gas curtain is thus formed, which rises at the cylindrical inner wall of the blowpipe 10.

It would also be possible, as an alternative, to connect the individual gas distribution chambers 24 (tangentially) to one another and to lead a single gas supply line into one gas distribution chamber 24. It is always ensured that the same gas pressure occurs in all channels 20, 22.

Designing a plurality of planes 16*a* . . . *f,* which may be adjacent to one another or be located at spaced locations from one another, rather than only one plane 16*a* . . . *f* as the gas purging device, also falls within the scope of the present invention.

The bricks 18 of the entire blowpipe area consist here of a refractory material based on magnesia with 0.5 wt. % of metallic aluminum added in a particle size fraction of 0.1 to 1.0 mm. The bricks are consequently free from chromium. The durability of the above-described snorkel corresponds to that of the prior-art snorkel (prepared with chromium-containing products) despite the use of chromium-free materials.

We claim:

1. A snorkel (10, 12) for a degassing vessel with a refractory lining (14) and with a gas-purging device arranged therein with a plurality of channels extending through said refractory lining (14) in the radial direction in relation to the central longitudinal axis of said snorkel (10, 12) and constructed and arranged to be connected on the outside to at least one gas supply line, said lining (14) consisting of a chromium-free refractory ceramic material at least in the area of said channels (20, 22), and, said channels being arranged at closely spaced locations from one another in a plurality of rows, each row extending around the circumference of said snorkel, each row being spaced axially from one another along the length of the inner wall of said snorkel to generate a nearly contiguous gas curtain along the length and circumference of the inner wall of said snorkel between the inner wall and any molten material flowing through said snorkel.

2. Snorkel in accordance with claim 1, whose said entire lining (14) consists of a chromium-free refractory ceramic material.

3. Snorkel in accordance with claim 1, in which the refractory material consists of a chromium-free MgO grade.

4. Snorkel in accordance with claim 3, in which the refractory material consists of $MgO-Al_2O_3$ spinel, magnesia spinel, magnesia with an MgO content exceeding 97 wt. % and doped with $ZrO_2$ or $Al_2O_3$, magnesia containing <1.0 wt. % of metallic additives in the granular form with a particle size of 0.1 to 2.0 mm, or magnesia with up to 8.0 wt. % of other refractory oxides added in a granulated, compacted or lumpy form with a particle size <5 mm.

5. Snorkel in accordance with claim 1, in which the refractory material of the said lining (14) is impregnated with pitch.

6. Snorkel in accordance with claim 1, in which the said channels (20, 22)

a) have a diameter between 0.5 and 2 mm, b) are spaced at a distance of less than 10 cm from each other, and c) gas can be admitted to said channels such that the gas rises adjacent to the inner wall of the said snorkel (10, 12) after entry into the said snorkel (10, 12).

7. Snorkel in accordance with claim 1 with a gas-purging device in the form of a monolithic, annular block made of a refractory material with said channels extending in it.

8. Snorkel in accordance with claim 1 with a gas-purging device in the form of an annular block made of a refractory material, which is formed by a plurality of refractory ring segments S1 through S10 with said channels (20, 22) arranged therein.

9. Snorkel in accordance with claim 8, wherein each said ring segment S1 through S10 consists of a plurality of bricks (18), through which at least one channel (20, 22) extends.

10. Snorkel in accordance with claim 1, wherein the distance between said adjacent channels is between 2 and 7 cm.

11. Snorkel in accordance with claim 1, wherein the said channels (20, 22) open at their outer end (at the gas supply-side end), in groups or all together, into a common gas distribution chamber (24).

12. Snorkel in accordance with claim 1, wherein the diameter of the said channels is smaller than 1 mm.

13. Snorkel in accordance with claim 1, wherein the channels (20, 22) are arranged rotationally symmetrically over the circumference of the refractory lining (14).

14. Snorkel in accordance with claim 1, wherein the channels (20, 22) are formed by metal tubes, which are firmly seated in the said refractory lining (14).

15. Snorkel in accordance with claim 1, wherein the channels are arranged offset in height.

16. Snorkel in accordance with claim 1, in which the channels (20, 22) have different cross-sectional areas.

17. A snorkel (10, 12) for a degassing vessel, the snorkel (10, 12) having (a) a refractory lining (14) forming an inner wall of the snorkel (10, 12), (b) a gas-purging device arranged in the refractory lining (14) and comprising a plurality of channels extending through the refractory lining (14) in a radial direction in relation to a central longitudinal axis of the snorkel (10, 12), said channels being arranged at closely spaced locations from one another in a plurality of rows, each row extending around the circumference of said snorkel, each row being spaced axially from one another along the length of the inner wall of said snorkel, and (c) means for connecting the channels to at least one gas supply line, the refractory lining (14) comprising a chromium-free refractory ceramic material, the channels (20, 22) being arranged at closely spaced locations along the refractory lining to generate a nearly contiguous gas curtain along the length and circumference of the inner wall of the snorkel (10, 12), the refractory material comprising $MgO-Al_2O_3$ spinel, magnesia spinel, magnesia with an MgO content exceeding 97 wt. % and doped with $ZrO_2$ or $Al_2O_3$, magnesia containing <1.0 wt. % of metallic additives in the granular form with a particle size of 0.1 to 2.0 mm, or magnesia with up to 8.0 wt. % of other refractory oxides added in a granulated, compacted or lumpy form with a particle size <5 mm, the refractory material of the said lining (14) being impregnated with pitch, the channels (20, 22) having a diameter between 0.5 and 2 mm, the channels (20, 22) being spaced at a distance of less than 10 cm from each other, and the channels being arranged such that gas admitted thereto rises adjacent to the inner wall of the snorkel (10, 12) after entry into the snorkel (10, 12).

18. Snorkel in accordance with claim 17 with the gas-purging device being in the form of an annular block made of a refractory material, which is formed by a plurality of refractory ring segments S1 through S10 with said channels (20, 22) arranged therein, wherein each ring segment S1 through S10 comprises a plurality of bricks (18), through which at least one channel (20, 22) extends, wherein the distance between adjacent channels is between 2 and 7 cm, wherein the channels (20, 22) open at their outer end (at the gas supply-side end), in groups or all together, into a common gas distribution chamber (24), wherein the channels (20, 22) are arranged rotationally symmetrically over the inner wall of the refractory lining (14), wherein the channels (20, 22) are formed by metal tubes, which are firmly seated in the refractory lining (14), wherein a portion of the channels are arranged offset in height with respect to another portion of the channels, and the channels (20, 22) having different cross-sectional areas.

* * * * *